US012017270B2

(12) United States Patent
Hentschel et al.

(10) Patent No.: US 12,017,270 B2
(45) Date of Patent: Jun. 25, 2024

(54) THREE-PLATE PRESSURE DIE CASTING MOLD HAVING IMPROVED SPRUE SEPARATION, AND METHOD FOR PRESSURE DIE CASTING

(71) Applicant: Bayerische Motoren Werke Aktiengesellschaft, Munich (DE)

(72) Inventors: Olaf Hentschel, Kumhausen (DE); Andre Schaefer, Rottenburg a.d.Laaber (DE); Manfred Tremmel, Niederaichbach (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 18/028,979

(22) PCT Filed: Aug. 26, 2021

(86) PCT No.: PCT/EP2021/073562
§ 371 (c)(1),
(2) Date: Mar. 28, 2023

(87) PCT Pub. No.: WO2022/069116
PCT Pub. Date: Apr. 7, 2022

(65) Prior Publication Data

US 2023/0330745 A1 Oct. 19, 2023

(30) Foreign Application Priority Data

Sep. 29, 2020 (DE) ..... 10 2020 125 343.5

(51) Int. Cl.
*B22D 17/20* (2006.01)
*B22D 17/22* (2006.01)
*B22D 17/24* (2006.01)

(52) U.S. Cl.
CPC ..... *B22D 17/2076* (2013.01); *B22D 17/2236* (2013.01); *B22D 17/229* (2013.01); *B22D 17/24* (2013.01)

(58) Field of Classification Search
CPC .... B22D 17/20; B22D 17/2076; B22D 17/22; B22D 17/2236; B22D 17/2272; B22D 17/229; B22D 17/24
(Continued)

(56) References Cited

U.S. PATENT DOCUMENTS 3,465,387 A 9/1969 Allard et al.
4,790,739 A 12/1988 Manfredi
(Continued)

FOREIGN PATENT DOCUMENTS

CN 204396832 U 6/2015
CN 204398267 U 6/2015
(Continued)

OTHER PUBLICATIONS

International Search Report (PCT/ISA/210) issued in PCT Application No. PCT/EP2021/073562 dated Nov. 2, 2021 with English translation (five (5) pages).
(Continued)

*Primary Examiner* — Kevin P Kerns
(74) *Attorney, Agent, or Firm* — Crowell & Moring LLP

(57) ABSTRACT

A three-plate pressure die casting mold for producing at least one metallic die casting part by die casting a metal melt, includes first, second and third mold parts and at least one mold cavity as well as a sprue system. A relatively movable pressure plate is arranged in the third mold part, which, when opening the die casting mold, presses the sprue produced in the sprue system against the first mold part, whereby the sprue is retained and tears off from the die casting part in a defined manner. A method for pressure die
(Continued)

Figure 1:
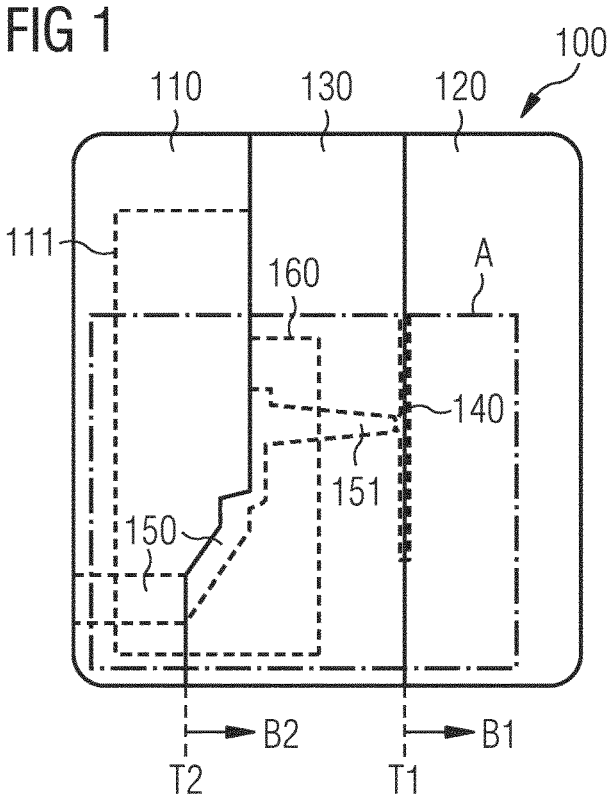

casting using the three-plate pressure die casting mold is disclosed.

10 Claims, 3 Drawing Sheets

(58) Field of Classification Search
USPC ..... 164/265, 339, 342, 344, 137
See application file for complete search history.

(56) References Cited

U.S. PATENT DOCUMENTS

| | | | |
|---|---|---|---|
| 6,139,305 | A | 10/2000 | Nesch |
| 6,558,149 | B1 | 5/2003 | Bodmer et al. |
| 8,602,769 | B2 | 12/2013 | Tseng et al. |
| 10,040,232 | B2 | 8/2018 | Liu et al. |
| 2005/0072550 | A1 | 4/2005 | Nagasaka et al. |
| 2014/0219862 | A1 | 8/2014 | Schirm et al. |
| 2017/0326770 | A1 | 11/2017 | Hirose et al. |

FOREIGN PATENT DOCUMENTS

| | | | |
|---|---|---|---|
| CN | 106001495 | A | 10/2016 |
| DE | 1976720 | U | 1/1968 |
| DE | 1 758 456 | A1 | 1/1971 |
| DE | 2146765 | A1 | 3/1972 |
| DE | 244 315 | A1 | 4/1987 |
| DE | 197 33 667 | A1 | 2/1999 |
| DE | 10 2011 018 255 | B3 | 6/2012 |
| DE | 10 2011 116 254 | B3 | 3/2013 |
| DE | 10 2012 107 363 | A1 | 3/2013 |
| DE | 10 2014 101 107 | A1 | 8/2014 |
| DE | 10 2016 003 031 | A1 | 9/2017 |
| DE | 10 2017 004 375 | A1 | 11/2017 |
| DE | 10 2017 220 410 | A1 | 5/2019 |
| DE | 10 2018 114 990 | A1 | 12/2019 |
| DE | 10 2017 124 150 | B4 | 1/2021 |
| EP | 0 488 508 | A2 | 6/1992 |
| GB | 625185 | A | 6/1949 |
| JP | 58-188638 | A | 11/1983 |
| JP | 9-323143 | A | 12/1997 |
| JP | 2008-178896 | A | 8/2008 |
| WO | WO 99/28108 | A1 | 6/1999 |
| WO | WO 2017/077949 | A1 | 5/2017 |

OTHER PUBLICATIONS

German-language Written Opinion (PCT/ISA/237) issued in PCT Application No. PCT/EP2021/073562 dated Nov. 2, 2021 (six (6) pages).

German-language Search Report issued in German Application No. 10 2020 125 343.5 dated Apr. 29, 2021 with partial English translation (10 pages).

International Search Report (PCT/ISA/210) issued in PCT Application No. PCT/EP2021/073229 dated Nov. 16, 2021 with English translation (four (4) pages).

German-language Written Opinion (PCT/ISA/237) issued in PCT Application No. PCT/EP2021/073229 dated Nov. 16, 2021 (five (5) pages).

German-language Search Report issued in German Application No. 10 2020 125 342.7 dated Apr. 29, 2021 with partial English translation (10 pages).

THREE-PLATE PRESSURE DIE CASTING MOLD HAVING IMPROVED SPRUE SEPARATION, AND METHOD FOR PRESSURE DIE CASTING

BACKGROUND AND SUMMARY

The invention relates to what is referred to as a three-plate die casting mold. The invention also relates to a method for producing at least one metal die-cast part by means of such a three-plate die casting mold.

As is known, during die casting, liquid metal melt is pressed at high pressure into the die cavity of a die casting mold (casting die), where it then solidifies. After the metal melt has solidified, the die casting mold is opened to remove the die-cast part (possibly also multiple die-cast parts) from the die. In order to be able to open and close the die casting mold, it has at least two mold parts (mold halves), with at least one of these mold parts being movable relative to the other mold part. The opening and closing are brought about using a die casting machine, which incorporates the die casting mold.

A die casting mold usually also has a sprue system which is formed by feed channels, distribution points, overflow points and/or the like, and via which the liquid metal melt enters the die cavity or is fed to the die cavity. The metal melt that has solidified in the sprue system is referred to as sprue. The sprue is separated from the actual die-cast part (shaped part) and disposed of as waste or recycled.

The prior art also discloses what are referred to as three-plate die casting molds, as described for example in the patent document DE 10 2012 107 363 A1. Such a three-plate die casting mold has a third mold part which is in the form of an intermediate plate, as it were, and is arranged so as to be movable between a first, typically stationary mold part, which in particular is on what is referred to as the sprue side, and a second, movable mold part, with the result that there are two mold parting planes. When the three-plate die casting mold is being opened, the die-cast part is pulled away from the sprue by the opening movement of the third mold part (intermediate plate), as a result of which the die-cast part and the sprue are forcibly parted (what is referred to as sprue separation) in that the sprue tears off from the die-cast part, or the die-cast part tears off from the sprue. The die-cast part can then be removed from the die by way of the first mold parting plane between the second mold part and the third mold part, and the sprue can be removed from the die by way of the second mold parting plane between the first mold part and the third mold part.

The three-plate die casting mold according to the invention of the independent claim has improved, very effective sprue separation, it then furthermore also being the case that the sprue can be removed from the die more easily. The additional independent patent claim expands the invention also to a method for producing at least one metal die-cast part by means of a three-plate die casting mold according to the invention, or using a three-plate die casting mold according to the invention. Additional features of the invention will become similarly apparent for the two subjects of the invention from the dependent patent claims, the following description of the invention, and the figures.

The three-plate die casting mold (also referred to simply as die casting mold below) according to the invention for producing at least one metal die-cast part by die casting a metal melt comprises a first, a second and a third mold part (mold plates), wherein the third mold part (intermediate plate) is arranged between the first and the second mold part. The die casting mold according to the invention further comprises at least one die cavity (in which the die-cast part to be produced is created) and also a sprue system, through which the metal melt is fed, or can be fed, to the die cavity. When this die casting mold is being opened, the sprue created in the sprue system is separated, or torn off, from the die-cast part created in the die cavity, with the die-cast part then being able to be removed, or being removed, from the die by way of a first mold parting plane between the second mold part and the third mold part, and the sprue being able to be removed, or being removed, from the die by way of a second mold parting plane between the first mold part and the third mold part.

According to the invention, in the third mold part there is arranged one or at least one relatively movable pressing plate (also referred to simply as pressing plate below), which, when the die casting mold is being opened in, or inside, the second mold parting plane, presses, or clamps, the sprue against the first mold part, as a result of which the sprue is retained and (thereby) tears off, or can tear off, from the die-cast part in a defined manner. In other words: In the third mold part there is arranged one or at least one relatively movable pressing plate, by means of which, when the die casting mold is being opened in the second mold parting plane, the sprue can be pressed, or is pressed, against the first mold part, in order to bring about or at least to promote defined tearing off (of the sprue) from the die-cast part.

A pressing plate is in particular understood to mean a plate-shaped mold part with a comparatively large-area end face, which is designed to be able to apply an extensive (non-punctiform) compressive force to the sprue. The end face has, for example, a rectangular shadow area with an edge length of up to 200 mm and more. The pressing plate has, for example, a thickness of 10 mm to 20 mm or more. The pressing plate may have different thicknesses in certain regions. Preferably, the pressing plate is arranged so as to be relatively movable in relation to a main body or the like of the third mold part, in particular in such a way that the pressing plate can move parallel to the opening direction, or closing direction, of the die casting mold.

In the case of the three-plate die casting mold according to the invention, the sprue is retained, or held in position, by means of the pressing plate when the die casting mold is being opened (that is to say, during the opening movement), in that the sprue is pressed, or clamped, in particular extensively, against the first mold part, at least until the sprue tears off from the die-cast part, with what is referred to as the tear-off travel being substantially determined by the elongation properties of the sprue. This ensures or at least assists defined and accurately repeatable tearing off of the sprue from the die-cast part at a determined point in time during the opening movement and/or at a determined relative position between the third mold part and the first mold part. The retention is effected without an undercut contour or the like, this moreover simplifying, or facilitating, the removal of the sprue from the die, or the ejection of the sprue, with the result that the arrangement of ejectors, or pushers, such as ejector pins or the like, is also less restrictive. The sprue system can also have a more complex configuration, for example such that multiple feed channels, which lead to a die cavity or possibly also to multiple die cavities, are provided in different mold planes and/or with different alignments (for example horizontal and vertical).

Preferably, the pressing plate is mounted, or guided, in the third mold part by means of multiple guide elements. These guide elements are preferably sliding guides (in the form, for example, of guide rails or guide strips with pockets of solid lubricant) or the like, which can be arranged in the corner regions of the pressing plate, in particular with a diagonal arrangement. The guide elements are preferably adjustable in order to enable adaptation to varying mold temperatures.

Preferably, at least one stop, which delimits the travel of the pressing plate toward the first mold part and in particular also prevents it from falling out is provided. The travel of the pressing plate is in particular dimensioned such that the sprue is retained, or clamped against the first mold part, at least until it tears off from the die-cast part, in order to ensure reliable sprue separation.

In a preferred first possible embodiment of the die casting mold according to the invention, at least one spring device, which pretensions the pressing plate toward the first mold part, or toward the sprue, is provided. That is to say, the pressing plate is actuated by means of at least one spring device. Preferably, multiple spring devices arranged at suitable points are provided. The third mold part, in particular its main body, can be formed with at least one pocket, that is to say with a recess or a depression or the like, in which the spring device is arranged. The pocket can, at least partially, also be formed in the pressing plate. The spring device is preferably a disk spring set comprising multiple disk springs. The compressive force that can be generated by the spring device is in particular dimensioned such that the sprue is reliably retained, that is to say, the compressive force generated is greater than the tensile force acting on the sprue when the die casting mold is being opened.

In an alternative second possible embodiment of the die casting mold according to the invention, it is provided that the third mold part has an adjustment mechanism for the pressing plate. That is to say, the pressing plate is actuated by means of an adjustment mechanism. The actuation is effected in particular in a travel-controlled manner depending on the opening movement of the third mold part. The adjustment mechanism is preferably in the form of a cam slider mechanism, which in particular has multiple cam sliders that are actuatable mechanically (for example by way of a slotted guide), electromechanically or hydraulically, as will be explained in more detail below.

The sprue system of the die casting mold according to the invention may have multiple (but at least one) feed channels, which are arranged in the third mold part, lead into the die cavity, and, at their die-cavity-side ends, that is to say in the region in which they lead into the die cavity, are each formed with a tapering which locally reduces, or locally narrows, the (respective) channel cross section and which makes it possible to create predetermined breaking points during the die casting operation at which the sprue tears off from the die-cast part. That is to say, the predetermined breaking points make it possible, when the die casting mold is being opened, to tear off the sprue from the die-cast part in a defined manner in terms of the parting points, or tear-off points, with the tearing off being effected in particular directly at the die-cast part. In interaction with the retention, or holding back, of the sprue that was explained above, this results in very effective sprue separation. Furthermore, the casting reworking of the die-cast part is made less complex. In addition, the mechanical loading of the die casting mold is decreased and the mold wear is reduced as a result.

Preferably, the feed channels in the third mold part that lead into the mold cavity have a conical, preferably spherical form, in particular with cross sections that become smaller toward the mold cavity, and, in addition to this conical form, at their die-cavity-side ends, are each formed with a tapering which locally reduces, or locally narrows, the channel cross section.

Preferably, the taperings at the die-cavity-side ends of the feed channels in the third mold part that lead into the die cavity are formed by a bead, or annular bead, or the like, each of which runs around the periphery, preferably around the entire periphery, in particular is shaped in collar-like fashion, and is arranged in particular in the opening cross section and locally narrows the respective feed channel in the opening cross section. This makes it possible to create, or shape, an annular-groove-like, in particular annular-notch-like, predetermined breaking point at the respective transition between the sprue, or a sprue web, and the die-cast part.

Preferably, the feed channels in the third mold part that lead into the die cavity are aligned perpendicularly or at least substantially perpendicularly to the die cavity. That is to say, the feed channels lead perpendicularly or at least substantially perpendicularly into the die cavity. This relates in particular to a die cavity for producing a thin-walled and/or sheet-like die-cast part, the feed channels being aligned perpendicularly to an areal extent of the die-cast part to be produced.

The method according to the invention for producing at least one metal die-cast part comprises at least the following steps:

- providing a three-plate die casting mold according to the invention, which in particular is incorporated in a die casting machine;
- closing the die casting mold and carrying out a die casting operation, with liquid metal melt being pressed into the die cavity (or into the die cavities) through the sprue system;
- opening the die casting mold after the metal melt has solidified, with the sprue created in the sprue system being pressed against the first mold part by the (relatively movable) pressing plate in, or inside, the second mold parting plane (during the opening movement) and is separated, or tears off, from the die-cast part in particular at least at one predetermined breaking point (see above);
- if appropriate, removing the die-cast part and the sprue from the die.

Preferably, when it is being opened, the die casting mold is opened first of all in the second mold parting plane between the third mold part (intermediate plate) and the first, in particular stationary, mold part (nozzle plate), in which also the sprue is removed from the die. In this context, the sprue can be separated, or tear off, from the die-cast part already at the start of the opening operation, that is to say at the start of the opening movement of the third mold part, which in particular is effected together with the second mold part.

The die-cast part to be produced is preferably a vehicle component, in particular a thin-walled and/or sheet-like light metal bodywork component, such as a longitudinal member element.

The invention will be explained in more detail below in relation to the figures and with reference to a particularly preferred possible embodiment (best mode). The features that are shown in the figures and/or explained below may be general features of the invention and correspondingly develop the invention also independently of specific combinations of features.

BRIEF DESCRIPTION THE DRAWINGS

FIG. 1 schematically shows a three-plate die casting mold according to an embodiment of the invention.

Figure 2:
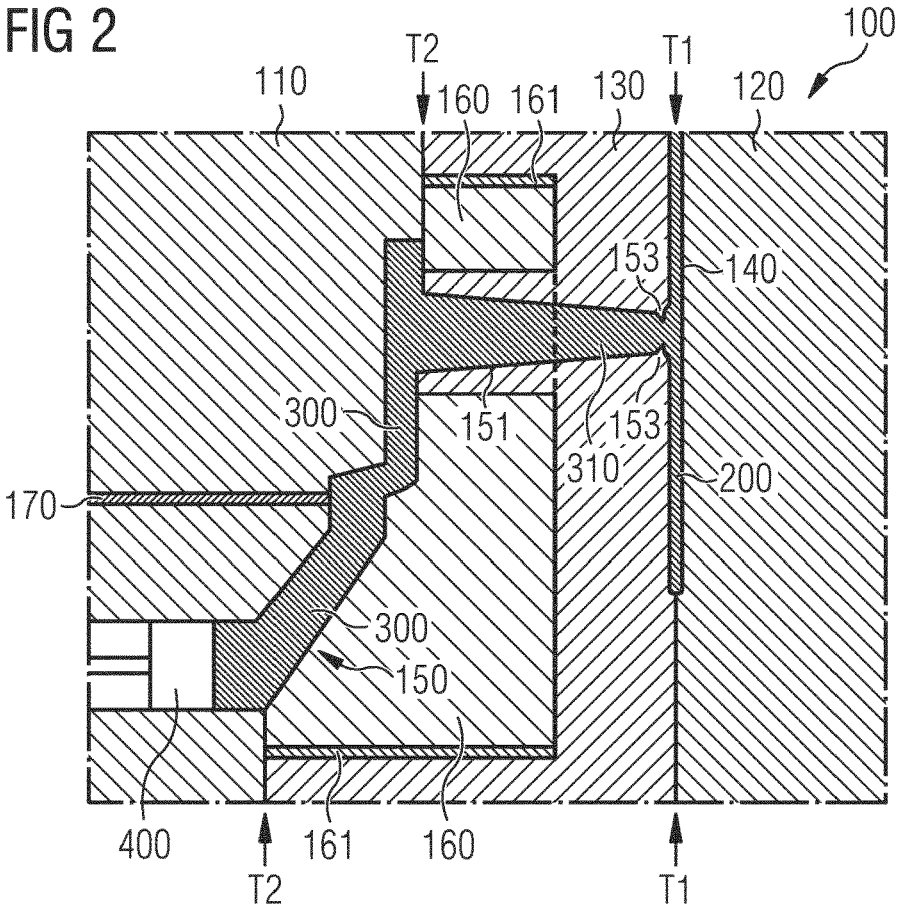
Figure 3:
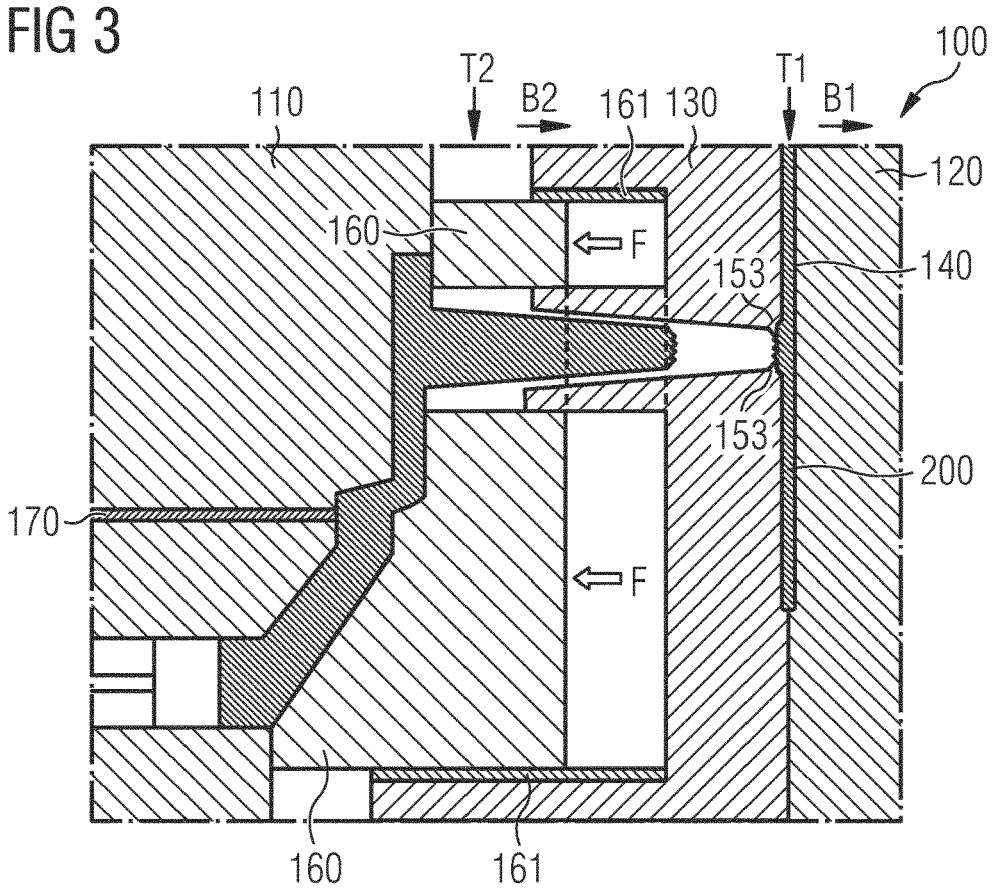
Figure 4:
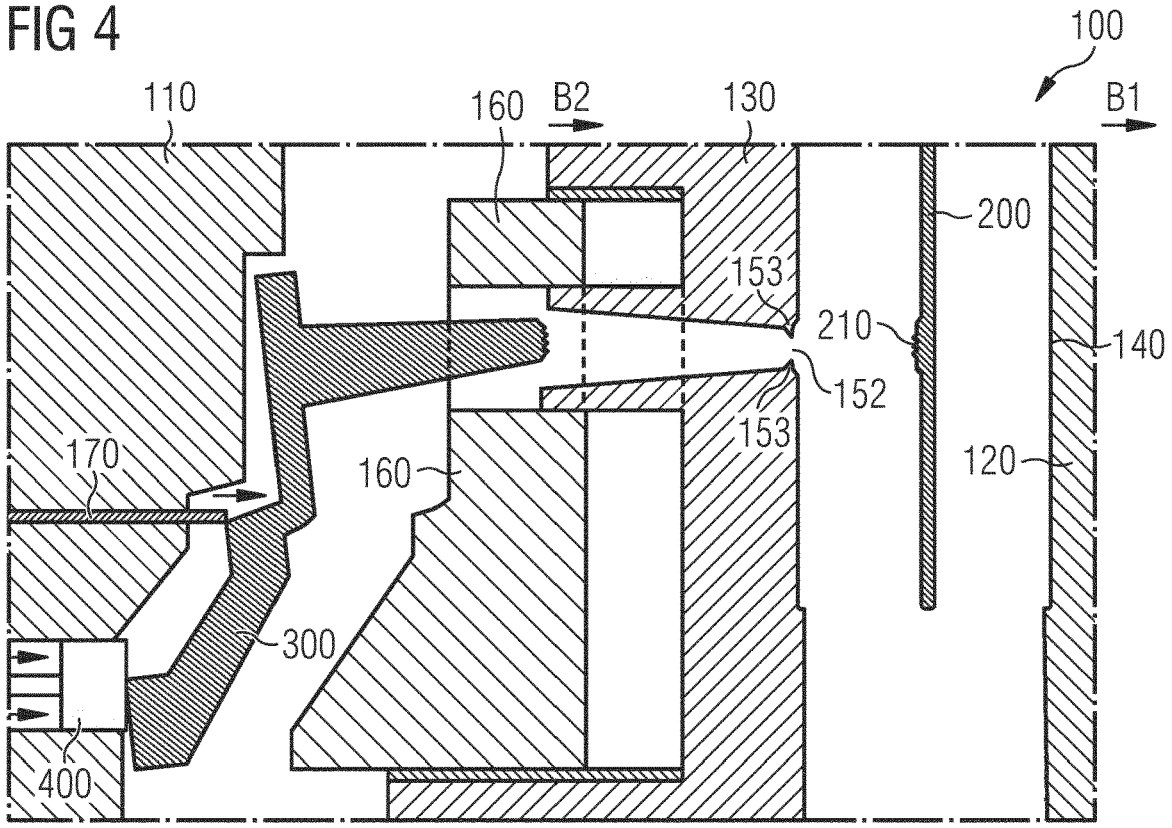

FIGS. 2 to 4 schematically depict the mode of operation of the die casting mold of FIG. 1 with reference to a mold detail selected by way of example (according to the region A identified in FIG. 1).

Figure 5:
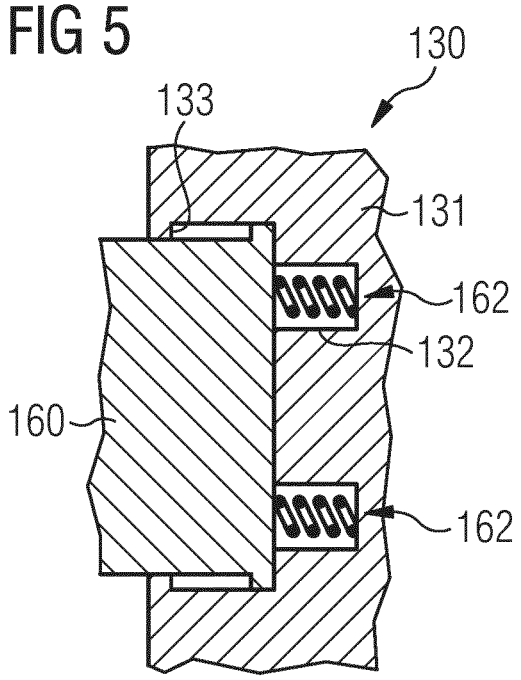

FIG. 5 schematically shows a preferred first possible embodiment for actuating the pressing plate in the die casting mold of FIGS. 1 to 4.

Figure 6:
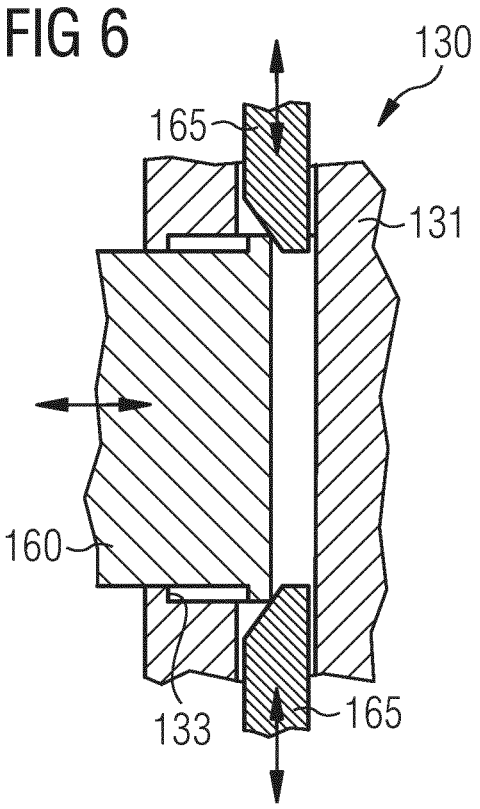

FIG. 6 schematically shows an alternative second possible embodiment for actuating the pressing plate in the die casting mold of FIGS. 1 to 4.

DETAILED DESCRIPTION THE DRAWINGS

The three-plate die casting mold 100 shown in FIG. 1 is incorporated in a die casting machine, which is not shown, and comprises a first, in particular stationary, mold part 110 (first mold plate), a second, movable mold part 120 (second mold plate) and a third mold part 130 (third mold plate), which is arranged between the first mold part 110 and the second mold part 120 and likewise is movable. The first mold part 110 may optionally have a sprue plate 111 in the form of an insert. The third mold part 130 has a relatively movable pressing plate 160, as explained in more detail below. The die casting mold 100 also comprises a die cavity 140, for example for producing a thin-walled light metal bodywork component, and a sprue system 150, through which liquid metal melt (for example aluminum melt or magnesium melt) enters, or is pressed into, the die cavity 140. The sprue system 150 can, for example, have a similar configuration to that described in DE 10 2012 107 363 A1. (In the figures, and nonlimitingly, only one die cavity 140 is illustrated, it also being possible for a three-plate die casting mold 100 according to the invention to have multiple die cavities.)

The three-plate die casting mold 100 advantageously makes it possible to feed the metal melt to the die cavity 140 laterally, and substantially perpendicularly with respect to an areal extent of the die-cast part to be produced. To that end, the sprue system 150 has multiple conical, and thus nozzle-shaped, feed channels 151 (also referred to as gates), which are arranged in the third mold part 130, or formed in the third mold part 130, and which lead, in particular substantially perpendicularly, into the die cavity 140. (In the figures, and nonlimitingly, only one of the feed channels 151 is illustrated, the explanations below referring to this one feed channel 151. A three-plate die casting mold 100 according to the invention may have multiple such feed channels 151 or only one such feed channel 151.)

There is a first mold parting plane T1 between the second mold part 120 and the third mold part 130, and a second mold parting plane T2 between the third mold part 130 and the first mold part 110. These mold parting planes T1, T2 are not planar surfaces in the mathematical sense, but complexly shaped mold parting points that are, however, referred to as mold parting planes. Moving, or displacing, the second mold part 120 and the third mold part 130, as depicted by the arrows B1, B2, makes it possible to open the die casting mold 100 at the mold parting planes T1, T2. Then, the die-cast part created in the die cavity 140 by the solidified metal melt can be removed from the die by way of the first mold parting plane T1, and the sprue created in the sprue system 150 by the solidified metal melt can be removed from the die by way of the second mold parting plane T2, as explained in more detail below with reference to FIGS. 2 to 4.

FIG. 2 shows the situation after the cavity 140 has been filled with liquid metal melt by way of the sprue system 150, with the die casting mold 100 closed. The metal melt solidifies in the die cavity 140 to form a die-cast part 200 and in the sprue system 150 to form what is referred to as a sprue 300, what is referred to as a sprue web 310 forming in the feed channel 151 of the sprue system 150.

After the metal melt has solidified, the die casting mold 100 is firstly opened in the second mold parting plane T2, as illustrated in FIG. 3. Here, the sprue 300 is pressed against the first mold part 110 by means of the pressing plate 160, as depicted by the arrows F. As a result, the sprue 300 is clamped in, as it were, and extensively retained. Because of the further opening movement B2, the sprue 300, or the sprue web 310, is separated, or torn off, from the die-cast part 200. The pressing plate 160 positions the sprue 300 in a defined manner for the sprue separation and the subsequent ejection operation.

The pressing plate 160 is arranged so as to be relatively movable in the third mold part 130 and is longitudinally movably mounted, or guided, by means of multiple guide elements 161 in such a way that it can move parallel to the opening movement B1/B2, that is to say horizontally. The guide elements 161 may be in the form of protruding guide stubs, which dip into the first mold part 110 when the die casting mold 100 is being closed, or are dipped in the first mold part (110) when the die casting mold 100 is in the closed state. This simplifies the mounting and maintenance of the pressing plate 160, which can be pushed in onto the protruding guide stubs and taken off of them. The guiding length is also increased.

The actuation, or application of force, can be effected by means of at least one spring device or by means of an adjustment mechanism (see FIG. 5 and FIG. 6). The end face of the pressing plate 160 is provided in particular such that an admissible surface pressure is not exceeded. The pressing plate 160 is in the form of a mold part and can also be considered to be a fourth mold part, or fourth mold plate. In the region of the feed channel 151, the pressing plate 160 has a cutout, it also being possible to provide that the feed channel 151 extends directly through the pressing plate 160, or is at formed least partially in the pressing plate 160.

The feed channel 151, formed in the third mold part 130, of the sprue system 150 has, at its die-cavity-side end, a tapering 153 that locally decreases the channel cross section. (The same applies in particular also for the other feed channels 151 in the third mold part 130 that lead into the die cavity 140.) In the opening cross section 152 to the die cavity 140, the tapering 153 is in the form of a bead or the like that runs around the periphery, in particular that is shaped in collar-like fashion (as can be seen in particular in FIG. 4). The local tapering 153 creates an annular-groove-like, in particular annular-notch-like, predetermined breaking point between the die-cast part 200 and the sprue 300 during the die casting operation, at which predetermined breaking point the sprue 300 is separated, or torn off, from the die-cast part 200 in a defined manner (and specifically directly at the die-cast part 200) already just after the start of the opening movement B2 of the third mold part 130, with the sprue 300, or the sprue web 310, being retained by means of the relatively movable pressing plate 160, thereby ensuring defined separation, or tearing off. Only a small, flash-free tear-off point 210 remains on the die-cast part 200.

The movement travel of the pressing plate 160 toward the first mold part 110 is delimited by a mechanical stop (see FIG. 5 and FIG. 6), with the result that the pressing plate 160, in the course of the further opening movement B2, lifts off from the sprue 300 and releases it (as shown in FIG. 4). After the die casting mold 100 has completely opened, the die-cast part 200 and the sprue 300 can be removed from the die. The removal of the sprue 300 from the die is effected by means of at least one ejector 170 in the first mold part 110, and optionally also by means of the casting piston 400 that is part of the die casting machine and ejects the butt. Ejectors, which are not shown, can likewise be provided to remove the die-cast part 200 from the die.

FIG. 5 shows (without structural detail) a first possible embodiment, in which the relatively movable pressing plate 160 is actuated by means of multiple spring devices 162. The spring devices 162 are in particular in the form of disk spring sets. The relatively movable pressing plate 160 is pretensioned toward the first mold part 110, or toward the sprue 300, by the spring devices 162. The spring devices 162 are arranged in pockets 132 formed in the main body 131 of the third mold part 130. Such pockets may also be formed in the pressing plate 160. The pockets 132 may be produced by machining, for example by milling. Also schematically illustrated is a stop 133, which delimits the travel of the pressing plate 160. The movement travel of the pressing plate 160 that is enabled, or the pressing plate stroke, must correspond at least to the opening travel, or the tear-off travel, of the third mold part 130 until tearing off occurs (what is meant by this is the tearing off of the sprue 300 from the die-cast part 200) and is in particular greater than the tear-off travel. The spring devices 162 are in particular designed such that the pressing plate 160 is not pressed against the stop 133 or is pressed against it only with a small force, in order to avoid excessive actions of force on the stop 133.

FIG. 6 shows (without structural detail) a second possible embodiment, in which the relatively movable pressing plate 160 is actuated by an adjustment mechanism, which is arranged substantially in the third mold part 130 and is in the form of a cam slider mechanism.

The actuation is effected in particular in a travel-controlled manner depending on the opening movement B2 of the third mold part 130. The cam slider mechanism has multiple cam sliders 165 that are driven mechanically (for example by way of a slotted guide), electromechanically, or by an electric motor, or hydraulically, optionally also pneumatically. Depending on the drive, the pressing plate 160 may also be pretensioned by the cam slider mechanism, that is to say virtually resilient cam sliders 165 are provided instead of the spring devices 162 shown in FIG. 5. The cam angle makes it possible to predefine a determined force transmission ratio and/or travel transmission ratio. The explanations above relating to the possible embodiment shown in FIG. 5 apply analogously to the stop 133 and the pressing plate travel.

In the case of the two possible embodiments shown in FIGS. 5 and 6, when the die casting mold 100 is being closed, the pressing plate 160 is reset, the resetting force being applied directly by the first mold part 110. The second possible embodiment shown in FIG. 6 may have resetting springs, which draw back the pressing plate 160 once the cam sliders 165 are moved back, in order for example, when the die casting mold 100 is open, to provide more space to remove the sprue 300 from the die.

LIST OF REFERENCE SIGNS

100 Three-plate die casting mold
110 First mold part (nozzle plate)
111 Sprue plate
120 Second mold part (closing plate)
130 Third mold part (intermediate plate)
131 Main body
132 Pocket
133 Stop
140 Die cavity
150 Sprue system
151 Feed channel
152 Opening cross section
153 Local tapering
160 Pressing plate
161 Guide element
162 Spring device
165 Cam slider
170 Ejector
200 Die-cast part
210 Tear-off point
300 Sprue
310 Sprue web
400 Casting piston
A Region
B1 Opening movement
B2 Opening movement
F Compressive force
T1 First mold parting plane
T2 Second mold parting plane

The invention claimed is:

1. A three-plate die casting mold for producing a metal die-cast part by die casting a metal melt, the die casting mold comprising:

a first mold part, a second mold part, and a third mold part, with the third mold part being arranged between the first and the second mold parts;

a die cavity;

a sprue system, through which the metal melt is fed to the die cavity; and a relatively movable pressing plate arranged in the third mold part, wherein:

when the die casting mold is being opened, a sprue created in the sprue system is torn off from the die-cast part created in the die cavity and the die-cast part is removable by way of a first mold parting plane between the second mold part and the third mold part, and the sprue is removable by way of a second mold parting plane between the first mold part and the third mold part, and when the die casting mold is being opened in the second mold parting plane, the relatively movable pressing plate in the third mold part moves relative to the third mold part so as to press the sprue against the first mold part, whereby the sprue is retained within the second mold part so as to tear off from the die-cast part in a defined manner.

2. The three-plate die casting mold according to claim 1, wherein the pressing plate is mounted in the third mold part via guide elements.

3. The three-plate die casting mold according to claim 1, wherein the pressing plate is pretensioned by a spring device.

4. The three-plate die casting mold according to claim 3, wherein the third mold part is formed with a pocket in which the spring device is arranged.

5. The three-plate die casting mold according to claim 3, wherein the spring device is a disk spring set.

6. The three-plate die casting mold according to claim 1, wherein the third mold part has an adjustment mechanism for the pressing plate.

7. The three-plate die casting mold according to claim 6, wherein the adjustment mechanism is a cam slider mechanism.

8. The three-plate die casting mold according to claim 1, wherein the sprue system has multiple feed channels, which are arranged in the third mold part, lead into the die cavity, and, at their die-cavity-side ends, are each formed with a tapering which locally reduces a channel cross section and which creates a predetermined breaking point during the die casting at which the sprue tears off from the die-cast part.

9. A method for producing a metal die-cast part, comprising:

providing a three-plate die casting mold comprising:

a first mold part, a second mold part, and a third mold part, with the third mold part being arranged between the first and the second mold parts;

a die cavity;

a sprue system, through which a metal melt is fed to the die cavity; and a relatively movable pressing plate arranged in the third mold part, wherein a first mold parting plane is between the second mold part and the third mold part, and a second mold parting plane is between the first mold part and the third mold part;

closing the die casting mold and carrying out a die casting operation, with metal melt being pressed into the die cavity through the sprue system;

opening the die casting mold after the metal melt has solidified, wherein:

when the die casting mold is being opened, a sprue created in the sprue system is torn off from the die-cast part created in the die cavity and the die-cast part is removable by way of the first mold parting plane, and the sprue is removable by way of the second mold parting plane, and when the die casting mold is being opened in the second mold parting plane, the relatively movable pressing plate moves relative to the third mold part so as to press the sprue against the first mold part, whereby the sprue is retained within the second mold part so as to tear off from the die-cast part in a defined manner.

10. The method according to claim 9, wherein the die-cast part to be produced is a vehicle component.

* * * * *